United States Patent [19]

Averill

[11] Patent Number: 5,011,150

[45] Date of Patent: Apr. 30, 1991

[54] GOLF TEE RETRIEVING SYSTEM

[76] Inventor: David B. Averill, 4706 Glenbrooke Ter., Sarasota, Fla. 34243

[21] Appl. No.: 543,209

[22] Filed: Jun. 25, 1990

[51] Int. Cl.[5] ..... A63B 57/00; A63B 53/00

[52] U.S. Cl. ..... 273/162 C; 273/211; 273/DIG. 30; 294/19.1

[58] Field of Search ..... 273/32 R, 32 B, 32 F, 273/33, 211, 212, DIG. 30, 183 A, 162 R, 162 E, 162 C; 294/19.1

[56] References Cited

U.S. PATENT DOCUMENTS 2,154,989 4/1939 Moore ..... 273/162 C 3,895,797 7/1975 Moore ..... 273/DIG. 30

4,244,576 1/1981 Mosier et al. ..... 273/162 E

*Primary Examiner*—George J. Marlo

*Attorney, Agent, or Firm*—Charles J. Prescott

[57] ABSTRACT

A golf tee retrieval system for retrieving a golf tee lying atop the ground utilizing a golf club. The system includes a golf tee having one member of two part releasably engagable hook and loop system connected atop the golf ball receiving and supporting surface of the golf tee. The other portion of the hook and loop system is connectable onto the upper end of a golf club. Thus, the hook and loop members so opposingly connected, cooperate to allow the user to simply touch the golf tee head with any portion of the upper end of the golf club to quickly retrieve the golf tee after use.

2 Claims, 1 Drawing Sheet

GOLF TEE RETRIEVING SYSTEM

BACKGROUND OF THE INVENTION

The present invention relates generally to golf tees, and more particularly to a golf tee retrieval system for quickly and easily recovering golf tees after use.

No prior art devices known to applicant accomplish the primary desired object of this invention, i.e. the quick retrieval of golf tees from atop the ground after use at a driving tee. Typically, the tee may be dislodged from the ground as the ball is driven there from and may be flipped through the air away from the golfer. Because golfers are fanatic about the high cost of tees, they must always be retrieved manually by bending over to allow at least for the inspection of broken shafts so that they may be either kept or discarded. Because a considerable number of golfers are aged or have weak back muscles, back strains resulting from the retrieval of these valuable accessories, which may be entangled in grass, is common.

Applicant has found that, in developing the present invention, a secondary benefit has manifested itself. This benefit derives from the textured surface of one part of the two part VELCRO releasable attaching system adhered atop the golf ball supporting portion of the head of a golf tee. This benefit is in the form of increased drive distance of golf balls struck there from. Applicant suggests that the textured surface, particularly when utilizing the VELCRO "hook" portion atop the golf tee, effects the spin of the golf ball as it is driven from the tee so as to enhance the roll of the golf ball once it contacts the fairway.

Applicant is now aware of a number of devices which are intended to modify the flight of a golf ball as it is driven from the tee. One such device is disclosed in U.S. Pat. No. 4,418,909 to Messana which teaches the use of an adhesive surface added atop the golf ball supporting portion of a tee. Another device is disclosed in U.S. Pat. 4,783,077 invented by Lemon which discloses a golf tee having a plurality of flutes which project upwardly and outwardly so that the golf ball is supported only on a plurality of points. Another device disclosed in U.S. Pat. No. 3,473,812 to Pelzmann is directed to a golf tee having an enlarged asymmetric golf ball supporting surface. Finally, applicant is aware of the invention to Post as disclosed in U.S. Pat. No. 3,288,470 which provides a uniquely structured golf tee for correcting a hook or a slice.

The present invention provides a golf tee retrieval system for use in conjunction with any golf club, or its equivalent, available to the golfer whereby, after use, a tee may be quickly retrieved from atop the ground without the painful and anguishing gymnastics of having to bend over to manually grasp and retrieve the tee from the grass by hand. Additionally, the invention provides for enhanced ball flight dynamics which appears to increase the roll of golf ball struck from the present invention.

BRIEF SUMMARY OF THE INVENTION

This invention is directed to a golf tee retrieval system for retrieving a golf tee lying atop the ground or entangled in grass utilizing a golf club. The system includes a golf tee having one member of a two part releasably engagable hook and loop system connected atop the golf ball receiving and supporting surface of the golf tee. The other member, either hook or loop, is connectable onto the upper end of a golf club. Thus, the hook and loop members so opposingly connected, cooperate to allow the user to simply touch the golf tee head with any portion of the upper end of the golf club to quickly retrieve the golf tee after use.

It is therefore an object of this invention to provide a golf tee retrieval system for easy and economical use in conjunction with a conventional golf club or its equivalent which will facilitate the easy and quick releasable attachment of the upper end of the golf club to the head of a golf tee when lying atop the ground or entwined in grass.

It is another object of this invention to provide the above system which is easily installable onto the upper end of any conventional golf club.

It is yet another object of this invention to provide a golf tee retrieval system, the modified golf tee portion of which also has a secondary benefit of enhanced golf ball flight dynamics which increase the roll of the golf ball after it contacts the ground.

In accordance with these and other objects which will become apparent hereinafter, the instant invention will now be described with reference to the accompanying drawings.

DETAILED DESCRIPTION OF THE INVENTION

Figure 1:
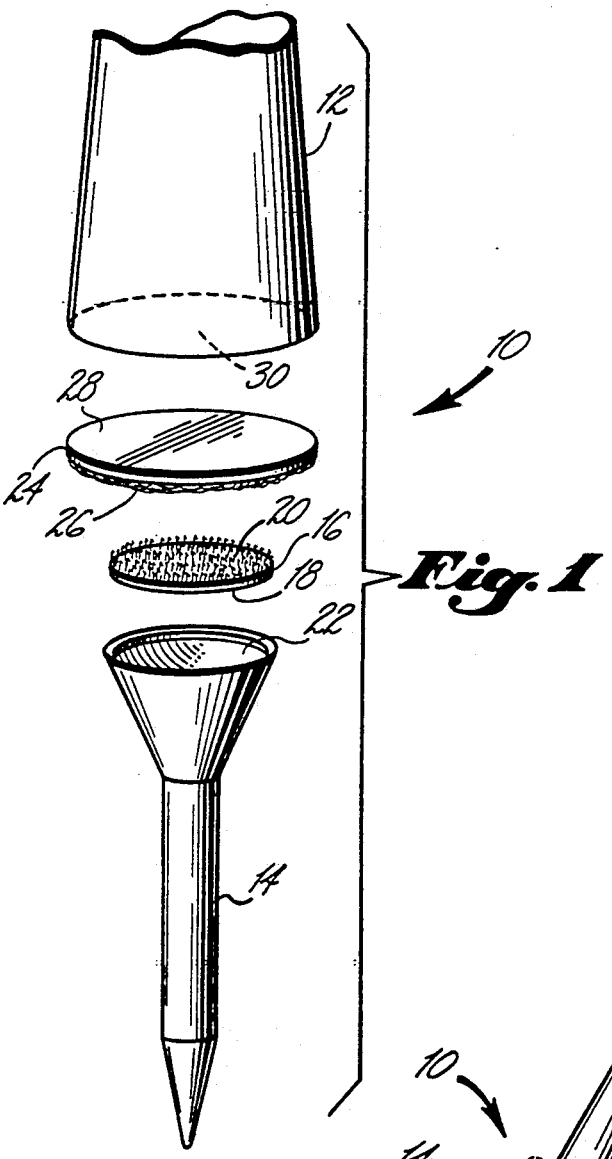
FIG. 1 is an exploded perspective view of the invention.

Referring now to the drawings, the invention is shown generally at numeral 10 and includes a conventional golf tee 14 having an upper golf ball supporting surface 22 at the upper end of the enlarged head thereof. Connected atop the golf ball supporting surface 12 is one portion or member 16 of a two-part VELCRO hook and loop system. In the preferred embodiment, this member 16 includes a "hook" surface 20 of the VELCRO two-part system. This member 16 includes an adhesive lower surface 18 which facilitates connection atop surface 22 of tee 14.

The loop member 24 of the VELCRO system is sized to be connected by an adhesive back surface 28 over the upper end 30 of the handle 12 of a conventional golf club. The loop surface 26 of VELCRO member 24 is well known to quickly but releasably interengage with the hook surface 20 of VELCRO member 16.

Figure 2:
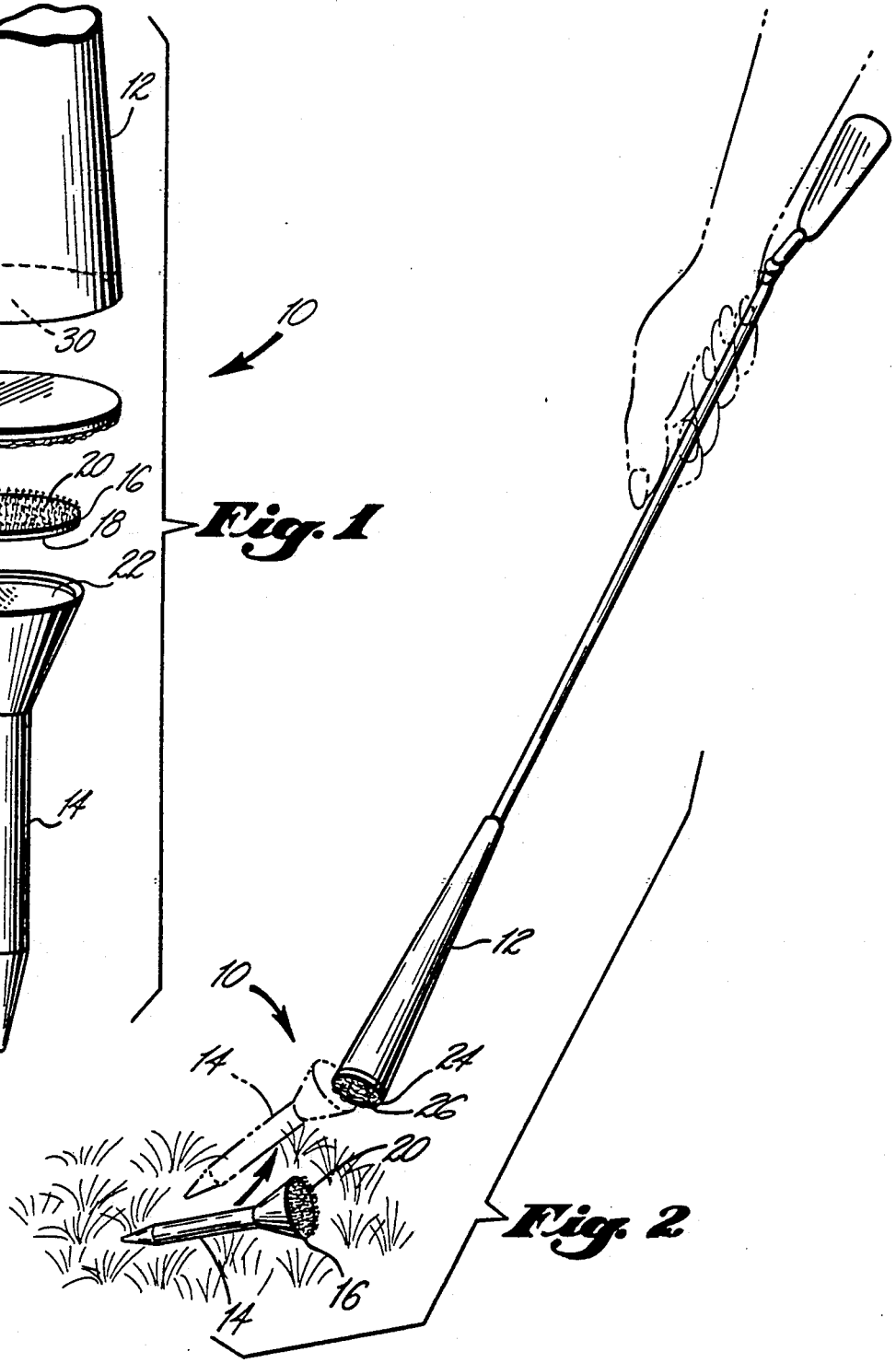
FIG. 2 is a pictorial view of the invention in use.

Thus, by this arrangement as shown in FIG. 2, a golfer may grasp the lower end of the golf club and extend it downwardly toward the ground so that the loop surface 26 of VELCRO member 24 will easily attach to any portion of the hook surface 20 of VELCRO member 16 atop tee 14. Because the tee 14 is extremely light in weight, when any portion of the two VELCRO members exposed 20 and 26 surfaces touch, sufficient connection is made therebetween so that the tee 14 may be quickly retrieved, even when entangled in tall grass or in shallow water.

In the preferred embodiment, the VELCRO member 16 connected atop the golf ball supporting surface 22 of tee 14 includes the hook surface 20. It has been found by experiment that the hook surface 20 has a greater effect upon the flight rotational dynamics of a golf ball struck there from such that, the golf ball will roll further after making first ground contact so as to increase the overall drive distance of the golf ball.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A golf tee retrieving system comprising:

a golf tee having one portion of a mating two part releasably connectable hook and loop system connected atop an enlarged upper golf ball supporting surface of said tee;

the other portion of said hook and loop system adhesively connectable onto an upper handle end of a golf club;

said hook and loop system so connected releasably connecting the golf club handle to said golf tee for retrieval of said golf tee from atop the ground.

2. A golf tee retrieval system comprising:

a first sheet having a hook surface and a second sheet having a loop surface, said hook and loop surfaces releasably connectable one to another upon contact;

said first sheet connected atop an enlarged upper golf ball supporting surface of a golf tee with said hook surface exposed;

said second sheet connected onto an upper handle end of a golf club with said loop surface exposed;

said hook and loop surfaces releasably connecting said golf club handle end with said golf tee for retrieval of said golf tee from the ground.

* * * * *